United States Patent [19]

Shaffer

[11] 4,397,517

[45] Aug. 9, 1983

[54] REPAIRABLE CONNECTOR

[75] Inventor: Howard R. Shaffer, Millersburg, Pa.

[73] Assignee: AMP Incorporated, Harrisburg, Pa.

[21] Appl. No.: 266,553

[22] Filed: May 22, 1981

[51] Int. Cl.[3] ..... H01R 13/42

[52] U.S. Cl. ..... 339/217 S

[58] Field of Search ..... 339/217 S

[56] References Cited

U.S. PATENT DOCUMENTS

| | | | |
|---|---|---|---|
| 3,158,424 | 11/1964 | Bowen | 339/217 S |
| 3,200,355 | 8/1965 | Dahlen | 339/217 S |
| 4,084,876 | 4/1978 | Dinger | 339/217 S |
| 4,245,875 | 1/1981 | Shaffer et al. | 339/32 R |

FOREIGN PATENT DOCUMENTS

| | | | |
|---|---|---|---|
| 2717402 | 10/1978 | Fed. Rep. of Germany | 339/217 S |

*Primary Examiner*—John McQuade
*Assistant Examiner*—Gary F. Paumen
*Attorney, Agent, or Firm*—Frederick W. Raring; Adrian J. LaRue

[57] ABSTRACT

An electrical connector comprises an insulating housing having a contact receiving cavity extending therethrough from the wire entry face to the mating face. A contact terminal contained in the cavity has a wire connecting portion at its rearward end comprising a hollow cylindrical section of the terminal. A ferrule crimped or soldered to the end of a wire is received in this cylindrical wire connecting portion of the terminal. The ferrule is retained in position by a retaining spring on the terminal which has an integral shoulder or lance that bears against the ferrule. The ferrule can be readily removed from the terminal by flexing the spring radially outwardly and disengaging the lance from the ferrule. A wire can be fitted with a replacement ferrule by the use of readily available tools if repair of the connector is required.

12 Claims, 8 Drawing Figures

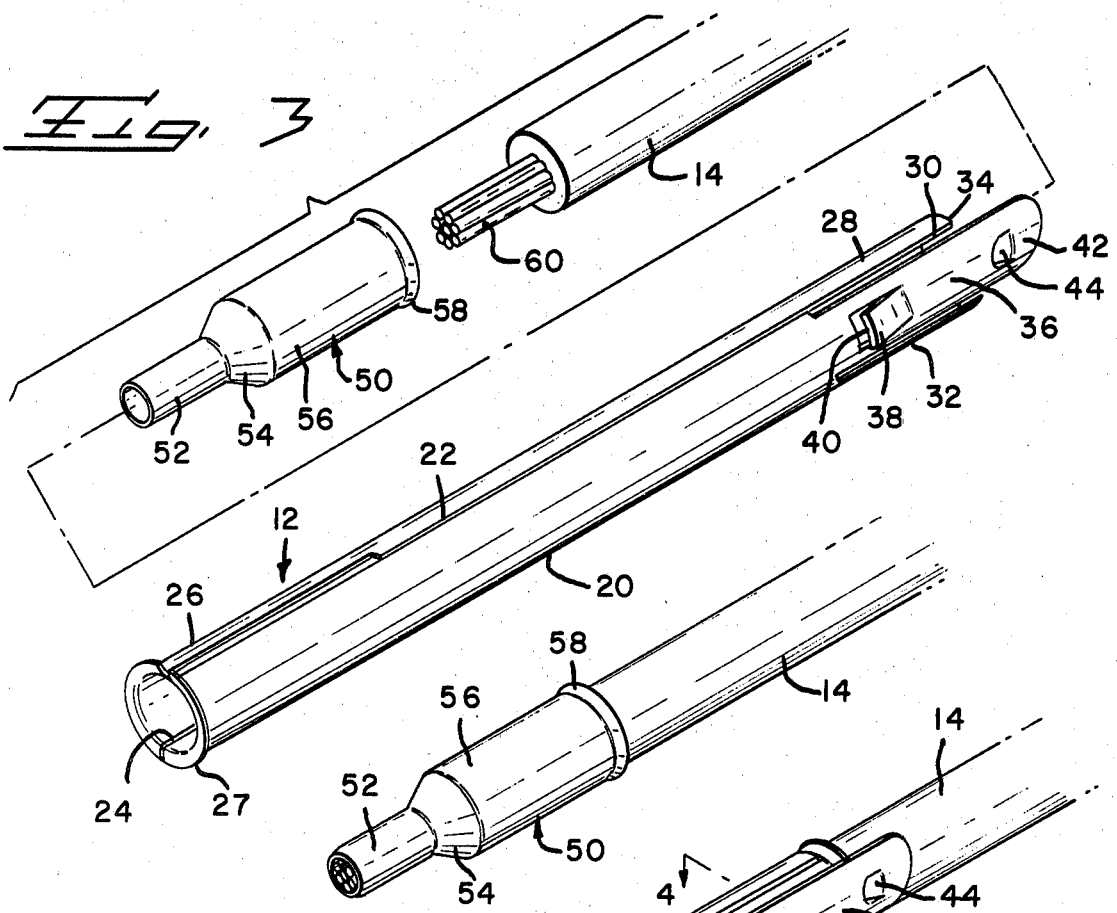
Fig. 3
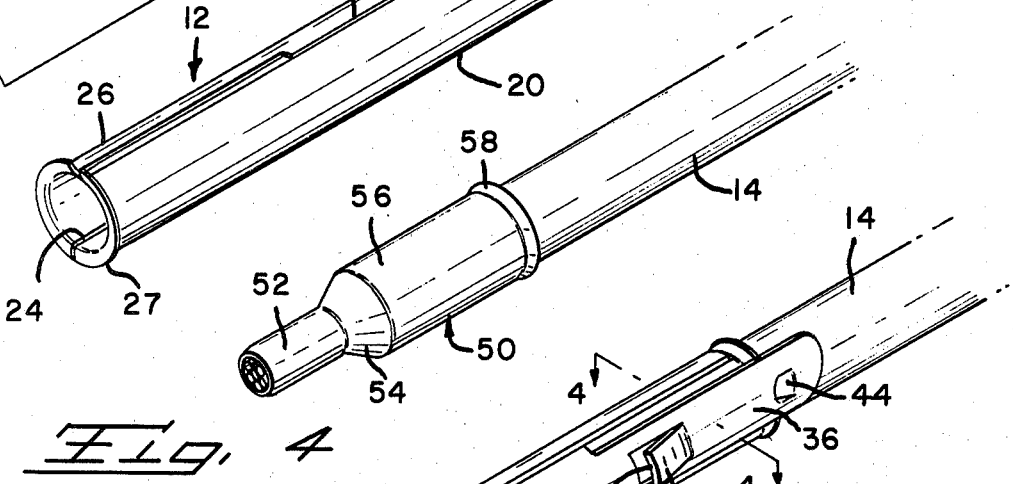
Fig. 4
Fig. 5
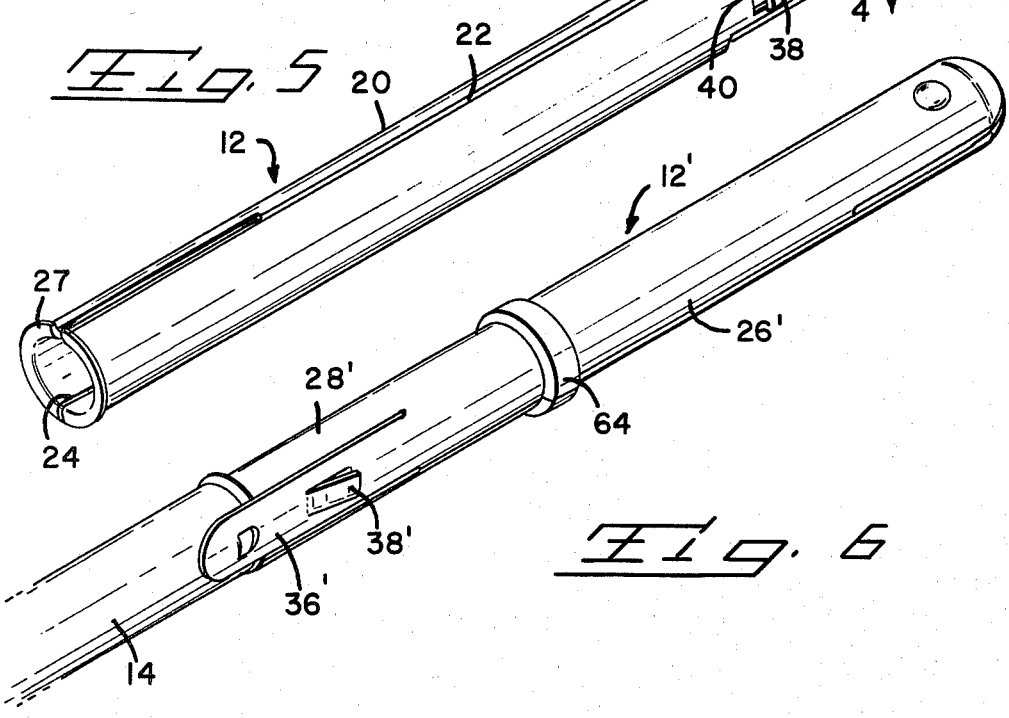
Fig. 6

REPAIRABLE CONNECTOR

FIELD OF THE INVENTION

This invention relates to electrical connectors of the type comprising a housing, contact receiving cavities in the housing, and wires extending into the housing which are electrically connected to the terminals. The invention is particularly concerned with a connector which can be readily repaired with the use of commonly available tools in the event of damage to the wires extending to the connector.

BACKGROUND OF THE INVENTION

U.S. Pat. No. 4,245,875 describes an electrical connector assembly which is intended for use on highway tractor trailers or agricultural tractors and agricultural implements. When the trailer is coupled to an over-the-highway or agricultural tractor, the electrical circuits in the trailer are connected to the control circuits and power circuits in the tractor by means of connectors on the tractor and on the trailer. The connectors used for this type of service must be robust and capable of withstanding hostile environments and abusive handling by semi-skilled or untrained personnel. Connectors used on highway and agricultural tractor trailers are subject to frequent damage, particularly failure of the wires, as when they are accidentally cut or severed and when such damage occurs, it is necessary to replace the terminal in the connector.

In accordance with the present practice, if a wire is severed, the terminal is removed from the connector housing, a new terminal is crimped onto the end of the severed wire (or the severed wire is replaced) and the new terminal is then inserted into the cavity which was vacated by the original terminal.

The operations of removing a terminal from the cavity in the connector, crimping a new terminal onto the wire, and inserting the terminal into the vacant cavity usually require specialized tools, such as crimping tools and possibly a terminal extraction or removing tool, and also require some skills on the part of the technician and some knowledge of the structure of the connector. If damage occurs at a location remote from a well equipped servicing center, such as a well-equipped shop, the tools may not be available and the technician assigned to perform the task may have only a limited knowledge of the structure of the connector and the repair steps he must carry out. The present invention is therefore directed to a connector which is improved in the sense that a damaged wire can be replaced with simple and readily available tools by a technician who has only very limited knowledge of the connector he must repair.

A connector in accordance with the invention has terminals contained in the terminal-receiving cavities of the connector housing. The terminals have cylindrical ferrule-receiving portions at their rearward ends. A wire is connected to the terminal by installing a simple cylindrical ferrule on the end of the wire and inserting this ferrule into the rearward end of the terminal. The rearward end of the terminal has an integral retaining spring which engages the ferrule after it has been inserted and retains it in the rearward end of the terminal. If a wire should be severed at any time, or if replacement of a wire is required for any reason, the retaining spring can be disengaged from the ferrule of the wire being replaced by the use of a simple readily available tool, such as a pocket knife blade or a screwdriver blade. A replacement ferrule can be installed on the end of a wire by use of a very simple crimping tool or by a soldering operation. The wire is reconnected to the terminal by then inserting the new ferrule into the rearward end of the terminal until the spring engages the new ferrule. The terminals in the connector are permanently installed and protected against damage so that the technician carrying out the repairs need never remove a terminal from the connector housing. The only parts required as spares, to permit repair of a connector, are a supply of cylindrical ferrules for the wires.

DESCRIPTION OF THE DRAWINGS

FIG. 3 is an exploded view of a socket contact terminal, a ferrule, and a wire on which the ferrule is installed.

FIG. 4 is a perspective view showing a wire having a ferrule installed on its end.

FIG. 5 is a perspective view of the socket contact terminal having a wire extending to its wire contacting end.

FIG. 6 is a perspective view of a contact pin in accordance with the invention.

PREFERRED EMBODIMENT OF THE INVENTION

Figure 1:
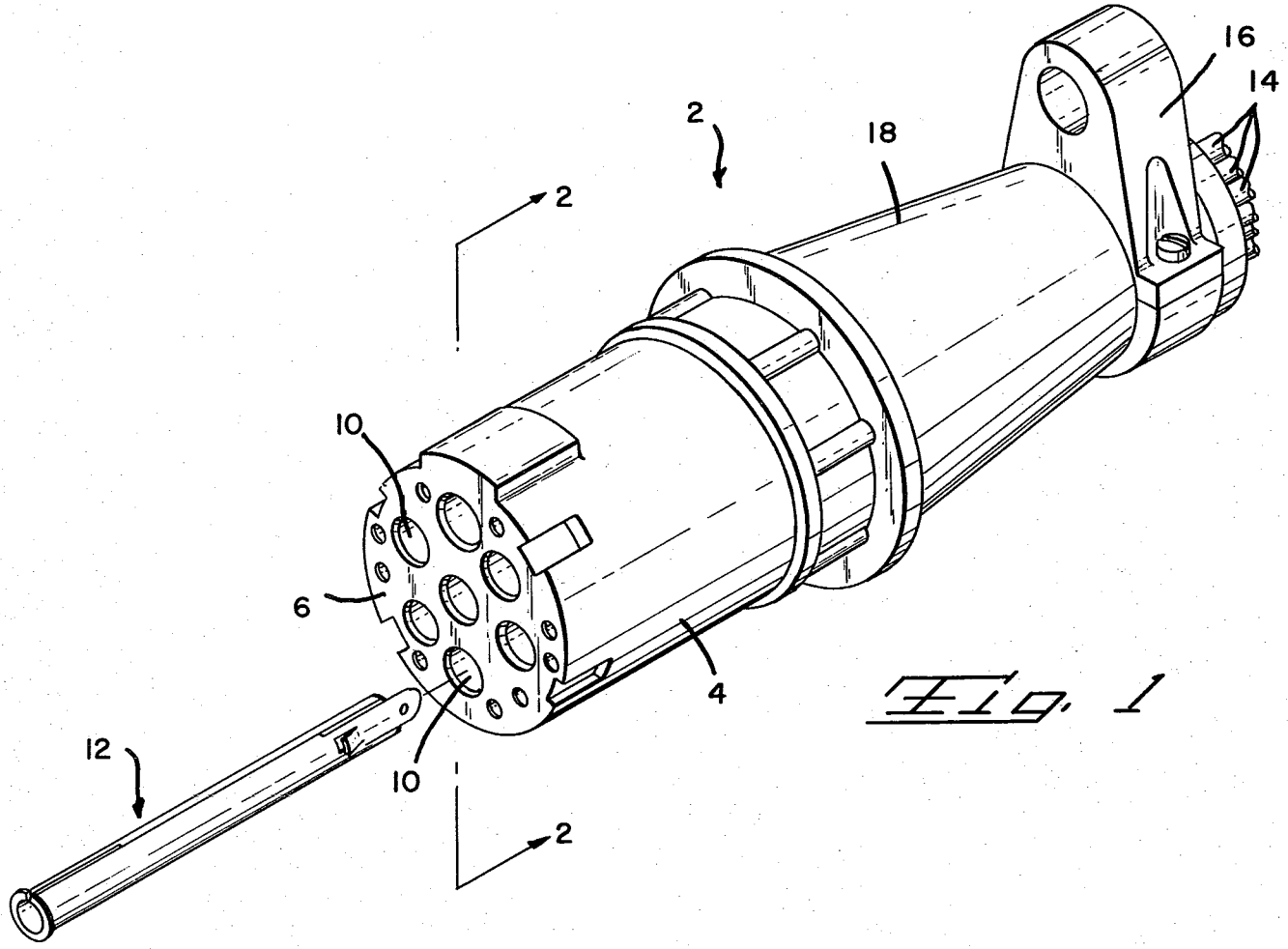
FIG. 1 is a perspective view of a connector plug in accordance with the invention showing one of the terminals exploded from the mating face of the plug housing.
Figure 2:
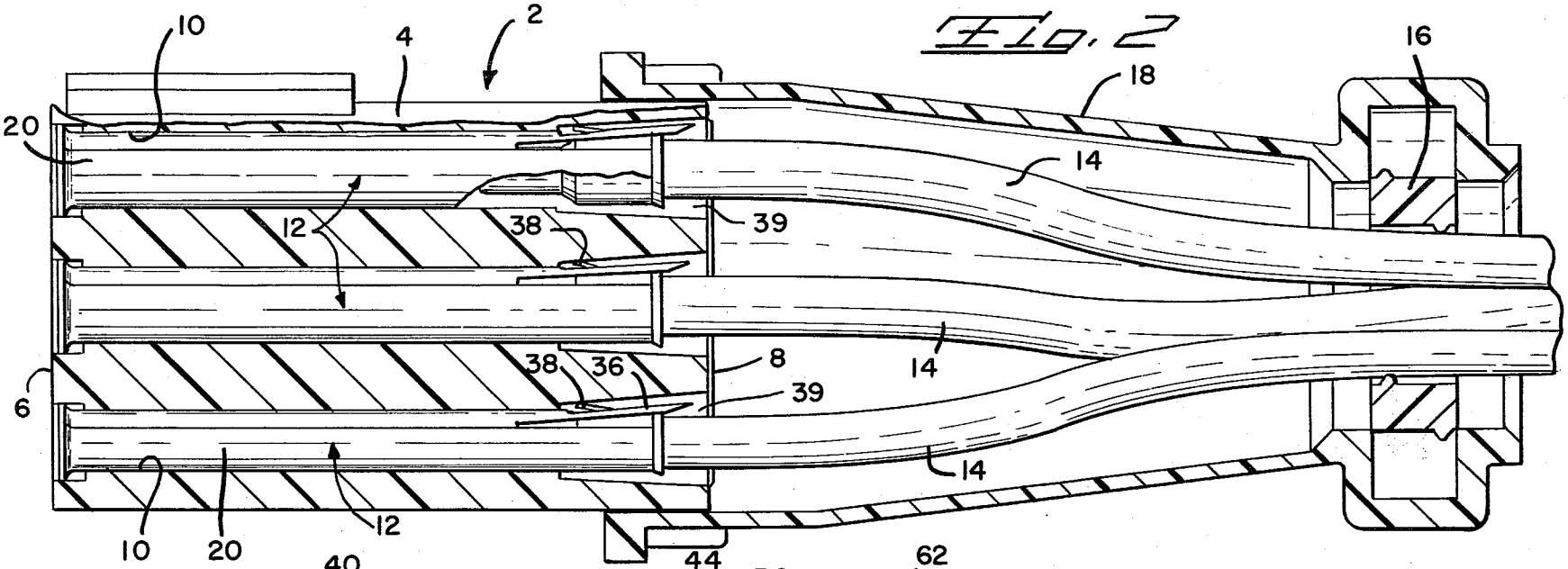
FIG. 2 is a cross-section view taken along the lines 2—2 of FIG. 1.
Figure 8:
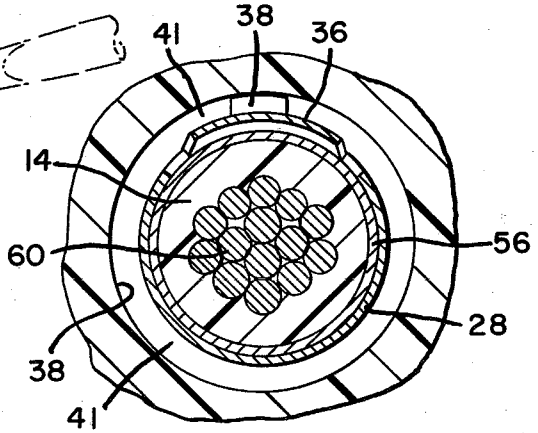
FIG. 8 is a view taken along the lines 8—8 of FIG. 7.

FIG. 1 shows a connector plug 2 of the general type described in U.S. Pat. No. 4,245,875 and incorporating the principles of the present invention. The connector plug 2 comprises a generally cylindrical housing 4 having a mating face 6, a wire entry face 8, and a plurality of contact-receiving cavities 10 extending between the two faces. A socket contact terminal 12 is contained in each of the cavities and wires 14 extend to a wire entry face 8, into the enlarged rearward portions 39 of the cavities, and are connected to the terminals in a manner described below. The wires are clamped adjacent to the wire entry face 8 by a clamping collar 16 which is contained in a back cover 18 that is mounted on the external surface of the housing adjacent to the wire entry face 8 as described in the above identified U.S. Pat. No. 4,245,875.

Each of the contact sockets 12 which are contained in the cavities 10 comprises a stamped and formed cylindrical member 20 having an axially extending open seam 22. The forward portion 26 of the cylindrical member 20 functions as a contact portion and receives the contact portion 26' of a complementary contact pin 12'. The forward portion is flared at its leading end, as shown at 27, and a slot 24 is provided which extends inwardly from the end 27 partially along the length of the cylindrical member 20. The slot 24 and the open seam 22 divide the contact portion into two semi-cylindrical sections which are sprung apart when the pin 12' is inserted thereby to provide contact forces in the contact portion 26′ of the pin.

The rearward portion 28 serves as the wire connecting portion of the terminal and is provided with a slot 32 which extends from the rearward edge 34 of this rearward portion partially along the length of the formed cylindrical member 20. The slot 34 and rearward portion 30 of the seam 22 define a segment 36 which functions as a retaining spring for the ferrule member 50, as described below. This segment is capable of outward flexure from its position shown in order to permit insertion and removal of the ferrule 50 into the rearward connecting portion 28 of the terminal socket.

The segment 36 extends beyond the trailing edge 34 of the rearward portion 28 of the terminal, as shown at 42. A ferrule retaining lance 44 is struck inwardly from this extension 42 and the forwardly facing edge 46 of this lance serves as a retaining shoulder for retaining the ferrule within the portion 28 of the cylindrical socket member 20.

The terminals 12 are inserted into the cavities 10 from the mating face 6 of the housing as illustrated in FIG. 1. The terminals are retained in their respective cavities by terminal retaining lances 38, each terminal having such a lance struck from its segment 36 as shown in FIG. 3. The lance 38 faces forwardly and its edge 40 engages a rearwardly facing shoulder 41 in the enlarged portion 39 of the cavity as shown in FIG. 7.

The ferrule 50 is a drawn or formed member having a reduced diameter nose portion 52, a conical transition section 54, and an enlarged diameter cylindrical section 56 on the edge of which there is a conical skirt 58. The nose portion 52 has an inside diameter which is dimensioned to receive the strands 60 of the wire 14 and after insertion of the wire into the ferrule 50, the strands 60 can be connected to the ferrule by crimping the nose portion 52 or by simply soldering the strands to the nose portion of the ferrule.

The outside diameter of the enlarged cylindrical portion 56 is substantially equal to and slightly greater than the inside diameter of the connecting portion 28 of the contact socket 12. Upon insertion of the ferrule which has been installed on the end of a wire 14 into the connecting portion of a terminal, the connecting portion will be circumferentially stressed to some extent so that a high contact force is established. Upon insertion of the ferrule into the rearward portion of the terminal, the segment 36 is flexed outwardly until the ferrule retaining lance 44 passes the flared skirt 58 of the ferrule at which time the segment returns to its normal position, as shown in FIG. 7. The edge 46 of the lance then bears against the rightwardly facing edge of the skirt 58 and the ferrule is thereby retained in the portion 28 of the terminal.

Figure 7:
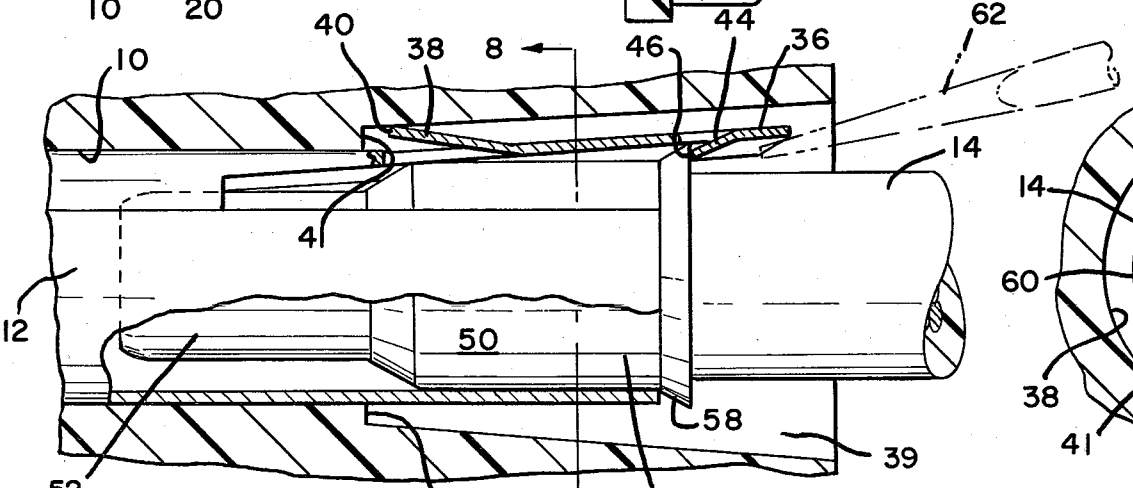
FIG. 7 is a fragmentary side view on an enlarged scale of the wire connecting portion of a terminal showing the manner in which the ferrule is retained in the wire connecting portion of the terminal.

The skirt 58 prevents movement of the ferrule into the portion 28 beyond the position shown in FIG. 7 and the terminal 12 is restrained against forward movement by virtue of the fact that the edge 40 of the lance 38 bears against the shoulder 41 of the cavity.

If an individual wire should be accidentally severed on a truck or trailer on which the connector is being used, the technician can remove the ferrule of the severed wire by simply inserting a blade 62 into the cavity and flexing the segment 38 outwardly from the axis of the terminal until the edge 46 is disengaged from the skirt 58 of the ferrule 50. The ferrule can then be removed. There is no possibility that the terminal will be pushed out of its cavity while this is being done, for the reason that the terminal retaining lance 38 is also in the segment 36 and this terminal retaining lance is also moved slightly outwardly when the segment is flexed. The edge 40 of the lance 38 cannot therefore become disengaged from the rearwardly facing shoulder 41.

The complementary connector receptacle which is used with the plug 2 is described in detail in U.S. Pat. No. 4,245,875. The receptacle will ordinarily contain contact pins as shown at 12′ having cylindrical contact portions 26′. These pins may be provided with an intermediate collar 64 but the wire connecting portion 28′ may be identical to the wire connecting portion 28 of the receptacle or socket terminal 12.

The ferrule 50 can be installed on the strands 60 of the wire by soldering, if a crimping tool is not available, when repairs are being made. The crimping operation, however, need not be carried out by specialized tools, but can be effected with an ordinary pair of pliers if care is taken to ensure adequate deformation of the reduced diameter nose 52 when it is crimped onto the strands 60. The technician performing the repairs need not handle the socket contact 12 and it is highly unlikely that he will damage the rearward end of the socket contact when he makes the repairs. The enlarged portion 39 of the cavity 10 permits only limited flexure of the segment outwardly from its normal position and the segment will not be overstressed during this limited flexure.

I claim:

1. An electrical connector of the type comprising an insulating housing having a mating face and a wire-entry face, a contact receiving cavity extending through said housing and between said faces, an electrical contact terminal in said cavity, said terminal having a contact portion which is proximate to said mating face and a wire connecting portion which is proximate to said wire-entry face, a wire extending into said cavity at said wire-entry face, said wire having its end portion connected to said terminal in said wire connecting portion, said connector being characterized in that:

said wire-connecting portion of said terminal is a hollow cylinder having a circular end edge which is adjacent to said wire entry face, said end portion of said wire has a cylindrical ferrule thereon, said ferrule having an outside diameter which is substantially equal to the inside diameter of said wire-connecting portion, said ferrule being received in said wire-connecting portion, said wire-connecting portion has a pair of spaced-apart axially extending slots extending from said end edge, the segment of said wire connecting portion which is between said slots being flexible radially outwardly with respect to said wire connecting portion, a ferrule retaining stop on the internal surface of said segment, said ferrule retaining stop being against a complementary stop on said ferrule and preventing movement of said ferrule from said wire connecting portion of said terminal, said ferrule being intentionally removable from said wire connecting portion upon flexing said segment radially outwardly thereby to disengage said ferrule retaning stop from said complementary stop.

2. An electrical connector as set forth in claim 1, said segment having an extension which extends rearwardly beyond said wire connecting portion, said retaining stop being on said extension.

3. An electrical connector as set forth in either of claims 1 or 2, said segment having a terminal retaining stop on the external surface thereof, said terminal retaining stop being opposed to a complementary cavity stop thereby to prevent movement of said terminal from said cavity.

4. An electrical connector as set forth in claim 3, said cavity having an enlarged portion proximate to said wire-entry face, portions of said segment being in said enlarged portion thereby to permit outward flexure of said segment.

5. An electrical connector as set forth in claim 4, said ferrule retaining stop comprising a ferrule retaining lance formed from said segment.

6. An electrical connector as set forth in claim 4, said terminal retaining stop comprising a terminal retaining lance formed from said segment.

7. An electrical connector as set forth in claim 4, said ferrule retaining stop comprising a ferrule retaining lance formed from said segment, said terminal retaining stop comprising a terminal retaining lance formed from said segment.

8. An electrical connector as set forth in claim 7, said terminal comprising a stamped and formed sheet metal part having an axially extending seam, one of said slots being said seam.

9. An electrical connector as set forth in claim 8, said contact portion comprising a cylindrical contact socket.

10. An electrical connector as set forth in claim 8, said contact portion comprising a contact pin.

11. An electrical connector as set forth in claim 7, said terminal retaining lance extending from said segment forwardly towards said mating face of said housing, said terminal retaining lance having a free end which is opposed to a rearwardly facing shoulder in said cavity whereby forward movement of said terminal towards said mating face is prevented.

12. An electrical connector as set forth in claim 1, said ferrule having an outside diameter which is substantially equal to, and greater than, the inside diameter of said wire connecting portion of said terminal.

* * * * *

UNITED STATES PATENT OFFICE

CERTIFICATE OF CORRECTION

Patent No. 4,397,517 Dated August 9, 1983

Inventor(s) Howard R. Shaffer

It is certified that error appears in the above-identified patent and that said Letters Patent are hereby corrected as shown below:

Column 4, line 61, change "retaning" to ---retaining---.

Signed and Sealed this

Sixth Day of March 1984

[SEAL]

*Attest:*

GERALD J. MOSSINGHOFF

*Attesting Officer*

*Commissioner of Patents and Trademarks*